US008104420B2

(12) United States Patent
Wiggins et al.

(10) Patent No.: US 8,104,420 B2
(45) Date of Patent: Jan. 31, 2012

(54) TETHERED TOW BODY, COMMUNICATIONS APPARATUS AND SYSTEM

(75) Inventors: James Wiggins, Thurmont, MD (US); Walter Allensworth, Poolesville, MD (US); Kevin Kieffer, Germantown, MD (US); Peter Owen, Monrovia, MD (US); Conrad Zeglin, Rockville, MD (US)

(73) Assignee: Adaptive Methods, Inc., Centreville, VA (US)

( * ) Notice: Subject to any disclaimer, the term of this patent is extended or adjusted under 35 U.S.C. 154(b) by 269 days.

(21) Appl. No.: 12/505,194

(22) Filed: Jul. 17, 2009

(65) Prior Publication Data

US 2011/0011323 A1 Jan. 20, 2011

(51) Int. Cl.
*B63B 21/56* (2006.01)

(52) U.S. Cl. ..... 114/253

(58) Field of Classification Search ..... 114/312, 114/313, 321, 322, 326, 328, 330, 331, 332, 114/342, 271, 274, 278, 288, 289, 290, 211, 114/212, 242, 244, 245, 253, 254; 441/21–26, 441/32, 33

See application file for complete search history.

(56) References Cited

U.S. PATENT DOCUMENTS 3,961,589 A 6/1976 Lombardi
3,972,046 A * 7/1976 Lombardi ..... 343/709
5,291,194 A 3/1994 Ames
5,379,034 A 1/1995 O'Connell
5,646,366 A 7/1997 O'Connell
6,058,874 A 5/2000 Glenning et al.
7,232,353 B1 6/2007 Gauthier
7,448,339 B2 * 11/2008 Bruengger et al. ..... 114/244

FOREIGN PATENT DOCUMENTS

RU 2 283 520 9/2006
RU 2 283 520 C1 9/2006

OTHER PUBLICATIONS

Roger E. Race, et al.; "Towed Antenna System Allows Two-Way, Real-Time Communication with UUVs"; Sea Technology Magazine; website: http://www.sea-technology.com/features/2011/0511/towed_antenna.php; pp. 1-6.

* cited by examiner

*Primary Examiner* — Daniel Venne
(74) *Attorney, Agent, or Firm* — Dickstein Shapiro LLP

(57) ABSTRACT

The problem of providing a submerged vehicle with above-the-surface communications to a nearby vessel, shore platform, or satellite while traveling at operating speed is solved by an efficiently deployable tethered tow body having a hydrodynamic and buoyant hull body and incorporating a lift-generating wing that provides hydrodynamic lift to efficiently lift the tow body containing antennas and other communications devices to the surface. The tow body allows for stable operation during underwater tow, surface tow, and transitions between underwater tow and surface tow. Disclosed embodiments include communications apparatuses encompassing the principles of the tethered tow body, as well as various underwater systems that incorporate a tethered tow body or communications apparatus for establishing communications with a nearby vessel, shore platform, or satellite.

39 Claims, 7 Drawing Sheets

TETHERED TOW BODY, COMMUNICATIONS APPARATUS AND SYSTEM

FIELD OF THE INVENTION

The invention relates generally to communications apparatuses, and in particular to a tethered communications apparatus that provides submerged vehicles with communications to the outside world.

BACKGROUND

Submerged vehicles, such as unmanned underwater vehicles (UUVs), are used in a variety of military applications, for example, surveillance, reconnaissance, navigation, and defense. When these vehicles are submerged, however, navigation and communication are difficult. Inertial navigation systems, such as gyroscopes or other computer and motion sensors that track position, orientation and velocity can be used, but these systems are subject to drift the longer they remain below the water surface. Highly accurate global positioning system (GPS) navigation systems and high-bandwidth radio frequency (RF) communications links are not directly available to submerged vehicles due to the rapid attenuation of radio frequency energy by water. Thus, submerged vehicles are limited to communicating with low bandwidth acoustics or wiring back to another vessel or shore platform.

Prior art communications devices for submerged vehicles, such as the device disclosed in U.S. Pat. No. 5,379,034, rely primarily on buoyancy to float an antenna to the water surface. The tow angle $\beta$ of a tethered cable, calculated as the angle between the cable and the direction the submerged vehicle is traveling, is affected by the speed of the submerged vehicle. The faster the vehicle travels, the smaller the tow angle $\beta$, resulting in the tethered cable being pulled straight back and the communications device never reaching the water surface. The slower the submerged vehicle travels, the larger the tow angle $\beta$, resulting in the tethered cable drifting straight up and the communications device drifting to the surface. Prior art devices that rely primarily on buoyancy require the submerged vehicle to be stationary or to be traveling at significantly reduced speed in order for the antenna to drift to the surface. Thus, submerged vehicles using these prior art devices cannot simultaneously communicate and travel at operational speed. Other prior art systems, such as those disclosed in U.S. Pat. Nos. 3,972,046 and 7,448,339, rely on an intermediary float tethered to an underwater vehicle and a surface float having an antenna. These prior art systems operate at very limited speed ranges because the surface floats would be pulled underwater at all but the slowest speeds. Additionally, the intermediary floats of these prior art systems are towed underwater, thereby increasing the probability of entanglement and drag when deployed. Still other prior art arrangements, including the antenna arrangement disclosed in U.S. Pat. No. 6,058,874, do not provide for conformal stowage in which a tethered communications device can be stowed within and be quickly deployed from an underwater vehicle, thereby, minimizing drag and the likelihood of vehicle entanglement during operation.

Accordingly, there is a need and desire for an efficiently deployable tethered communications apparatus and system for providing submerged vehicles with bi-directional, high data rate communications to a nearby vessel or shore platform as well as GPS coordinate data for precise navigation while traveling at operational speed.

DETAILED DESCRIPTION OF THE INVENTION

Figure 1:
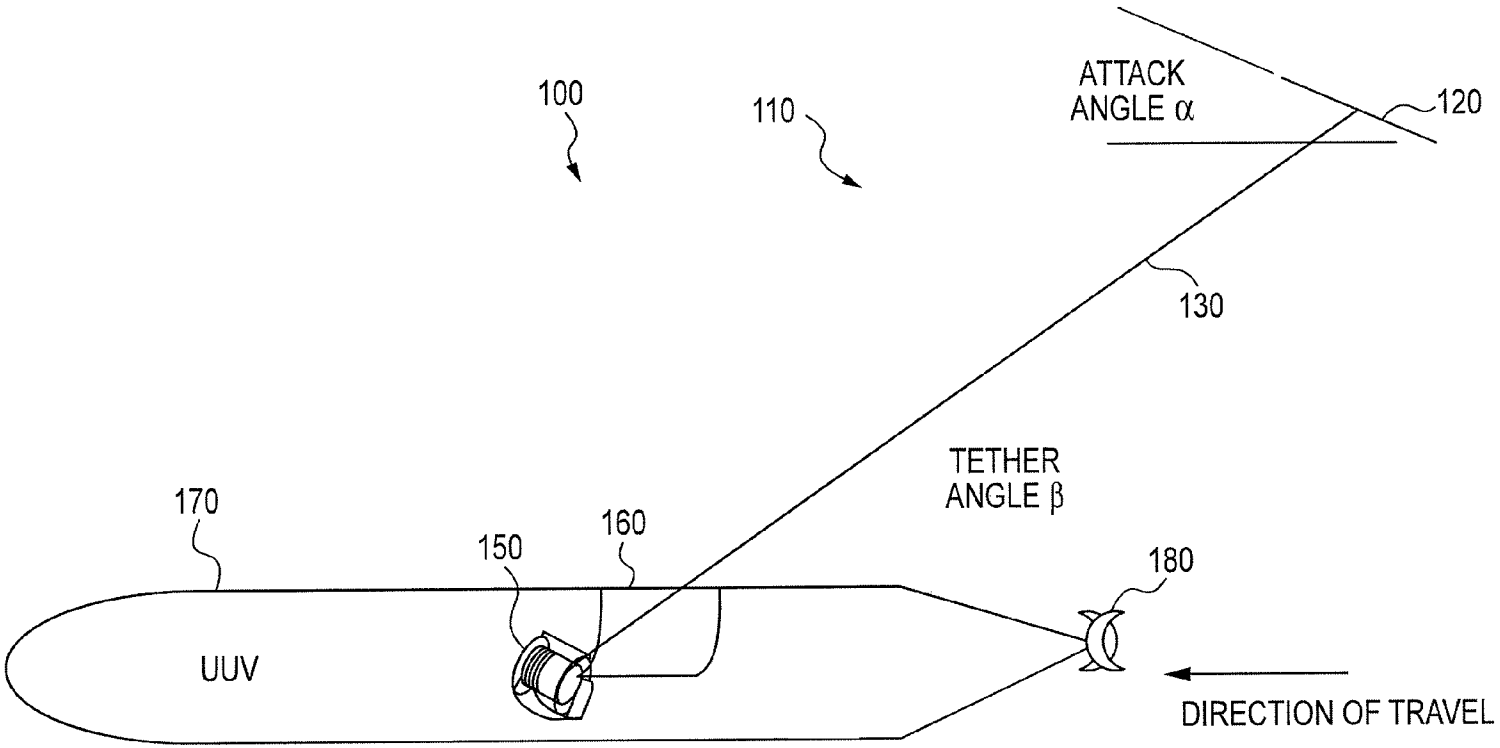
FIG. 1 is a diagram of a UUV system in accordance with an embodiment described herein.

In the following detailed description, reference is made to the accompanying drawings, which form a part hereof and illustrate specific embodiments that may be practiced. In the drawings, like reference numerals describe substantially similar components throughout the several views. These embodiments are described in sufficient detail to enable those skilled in the art to practice them, and it is to be understood that structural and logical changes may be made. Sequences of steps are not limited to those set forth herein and may be changed or reordered, with the exception of steps necessarily occurring in a certain order.

The problem of providing a submerged vehicle with above-the-surface communications to a nearby vessel, shore platform, or satellite while traveling at operating speed is solved by an efficiently deployable tethered tow body having a hydrodynamic and buoyant hull body and incorporating a lift-generating wing that provides hydrodynamic lift to efficiently lift the tow body containing antennas and other communications devices to the surface. The tow body allows for stable operation during underwater tow, surface tow, and transitions between underwater tow and surface tow.

Disclosed embodiments include communications apparatuses encompassing the principles of the tethered tow body, as well as various underwater systems that incorporate a tethered tow body or communications apparatus for establishing communications with a nearby vessel, shore platform, or satellite.

The invention may be used to particular advantage in the context of submerged vehicles. Therefore, the following example embodiments are disclosed in the context of UUV systems. However, it will be appreciated that those skilled in the art will be able to incorporate the invention into numerous other alternative systems that, while not shown or described herein, embody the principles of the invention.

FIG. 1 shows an underwater vehicle system 100 in accordance with an embodiment described herein. UUV 170 may be, for example, a modified ANT Glider Eyak 01 developed by Alaska Native Technologies, LLC or a modified Remus 600 developed by Hydroid, Inc. UUV 170 is modified to integrate with a communications apparatus 110 having a tether 130 connected on one end to a reeling assembly 150 within UUV 170 and on the other end to tow body 120. UUV 170 has propulsor 180 at the aft end and a tow body stowage area 160 cut out on the top surface of UUV 170. The tow body stowage area 160 has a length and width equal to the length and width of tow body 120, and a depth sufficient for tow body 120 to fit entirely within UUV 170.

In accordance with an advantageous feature of this disclosed embodiment, tow body 120 is deployed from the tow body stowage area 160 of UUV 170, thus, enabling UUV 170 to repeatedly establish communications with the outside world in a quick and efficient manner. Communications apparatus 110, comprising hydrodynamic tow body 120 and tether 130 connecting tow body 120 to reeling assembly 150, can be completely stowed inside the tow body stowage area 160 to achieve seamless integration within UUV 170. Communications apparatus 110 is positively buoyant enabling it to float to the surface using hydrostatic force when UUV 170 is stationary. If desired, vehicle guidance docking plates can be installed in the tow body stowage area 160 to help align tow body 120 inside UUV 170. Seamless integration of communications apparatus 110 has the effect of minimizing drag and minimizing the possibility of entanglement as UUV 170 moves underwater. The communications apparatus 110 and reeling assembly 150 are made so that they are collectively neutrally buoyant and, therefore, will not impact the depth control of UUV 170 when stowed or deployed.

The present inventors have discovered that tow bodies that combine a lift-generating wing and a stable body structure achieve good hydrodynamic performance. Therefore, in accordance with the embodiments described herein, tow body 120 has a lifting wing mounted on top of a tow body structure and, optionally, at least one side float arranged on either side of the body structure for providing buoyancy at the outer edges of lifting wing and to stabilize tow body 120 during underwater tow.

In accordance with an advantageous feature of the disclosed embodiment, tow body 120 is hydrodynamically clean in that it is designed to minimize drag during underwater tow, to achieve good hydrodynamic performance during surface tow, and to transition stably between underwater tow and surface tow. Tow body 120 is able to smoothly transition from underwater tow to being towed at least partially above the surface during communication. Additionally, tow body 120 is able to smoothly transition from surface tow to being towed below the surface during retrieval.

Figure 2:
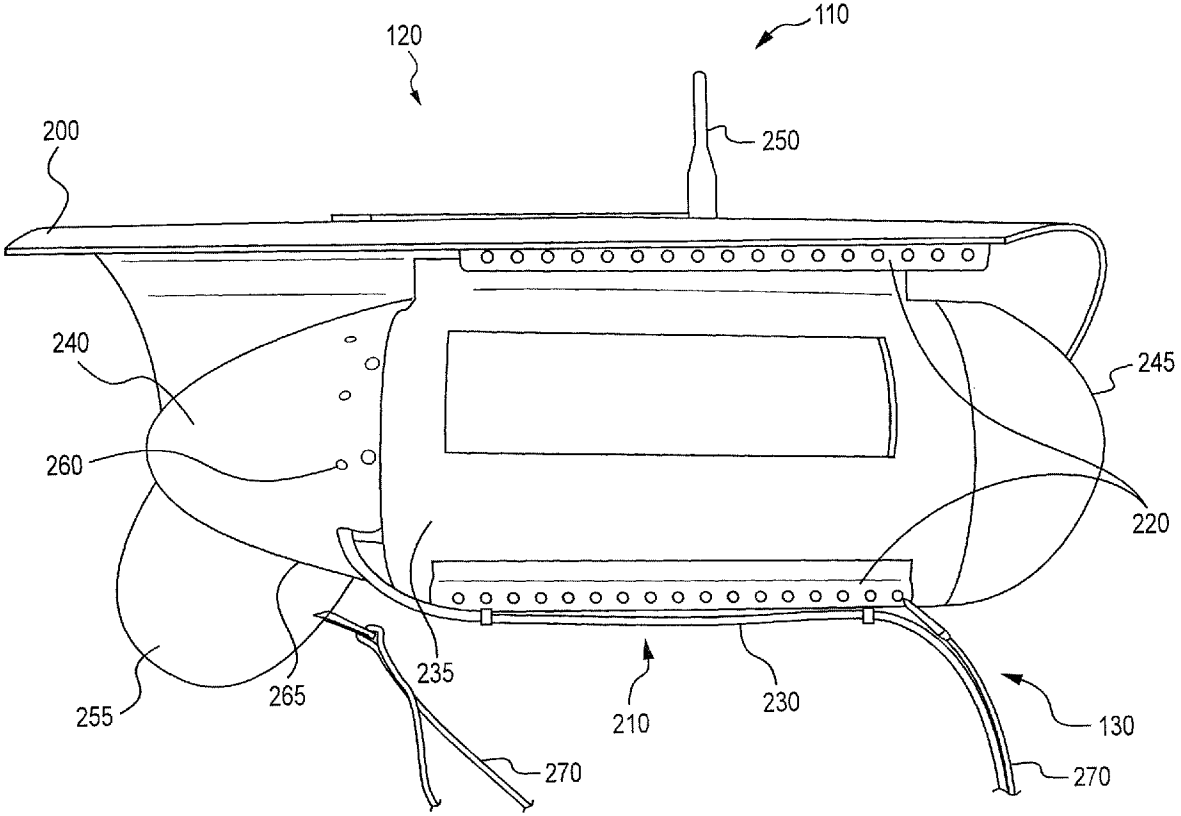
FIG. 2 is a diagram of a communications apparatus in accordance with an embodiment described herein.

FIG. 2 is a diagram of a communications apparatus 110 in accordance with an embodiment described herein. Communications apparatus 110 has a hydrodynamic tow body 120 with a mounted antenna 250 and a tether 130 attaching tow body 120 to reeling assembly 150. Tether 130 is comprised of tow cable 230 and bridles 270.

In the example embodiment of FIG. 2, tow body structure 210 is multi-sectional with an elongated center hull body 235, an aft section 240 and a fore section 245. Bulkheads are optionally placed at both ends of center hull body 235 to separate center hull body 235 from aft section 240 and fore section 245.

Lifting wing 200 is mounted on top of center hull body 235 to provide hydrodynamic lift for lifting an underwater tow body 120 to at least partially above the water surface. Lifting wing 200 is at least as long as the length of tow body structure 210 and is wider than the width of tow body structure 210, preferably, not greater than its length. The width of lifting wing 200, however, is constrained by the width of UUV 170. According to the example embodiment of FIG. 2, lifting wing 200 curves outward, forming a convex surface. Preferably, lifting wing 200 also has a convex fore end, which reduces drag as tow body 120 is pulled through water.

According to the example embodiment of FIG. 2, center hull body 235 has a cylindrical shape while the aft section 240 and fore section 245 are cone shaped. Aft section 240 and fore section 245 of tow body structure 210 have convex surfaces and are seamlessly integrated with center hull body 235. Preferably, aft section 240 is slightly longer than fore section 245. Vent holes 260 are used for cooling an electronics assembly located inside the center hull body 235.

Tow body structure 210 of the disclosed embodiment is made of polycarbonate, however, tow body structure 210 can be made of any other non-metallic material having positive buoyancy, such as, for example, carbonfiber, plastic, and fiberglass. The outer hull of tow body structure 210 is preferably coated with a fiberglass resin or polyester coating to provide a low drag surface.

Vertical stabilizer 255 extends from the bottom of tow body structure 210, preferably the bottom of aft cone 240, to keep tow body 120 substantially parallel with the water surface. If desired, vertical stabilizer 255 is mounted to tow body structure 210 through a keel slot 265 built on the underside of aft cone 240. In an advantageous feature of this embodiment, vertical stabilizer 255 is retractable during stowage to minimize the size of tow body stowage area 160 within UUV 170. Vertical stabilizer 255 can be made retractable using a spring or tether 130 can be used to extend vertical stabilizer 255 during deployment of tow body 120. Upon retrieval, vertical stabilizer 255 will be forced inside aft cone 240 by the rear edge of tow body stowage area 160.

According to the example embodiment of FIG. 2, communications apparatus 110 can provide UUV 170 with high-bandwidth RF communications link and GPS coordinate data. Antenna 250 is a 802.11 antenna providing bi-directional, high speed data rate of at least 1 Mbps at a distance of at least 1 km. Antenna 250 is preferably small for taking up the least amount of space in UUV 170 and for being less likely to be noticed when deployed above the surface. Antenna 250 should also be omnidirectional to allow it to change position relative to a remote receiver.

Antenna 250 should be as vertical as possible during surface tow so as to provide optimum communications to a nearby vessel or shore platform. In the disclosed embodiment, antenna 250 is spring mounted to lifting wing 200 to keep antenna 250 substantially upright during surface tow. Antenna 250 is preferably positioned to pivot slightly to the rear of tow body 120 to reduce the possibility of breakage if tow body 120 encounters an obstacle during tow. According to another advantageous feature of this embodiment, antenna 250 folds down during retrieval and stowage to reduce drag. It will be appreciated by those skilled in the art that an electromechanical device can be used to raise and fold the spring mounted antenna 250. Alternatively, a gimbaled antenna mount can be used to maintain correct antenna position. Those skilled in the art will appreciate that numerous other ways can be devised to keep antenna 250 substantially vertical during surface tow.

Figure 3:
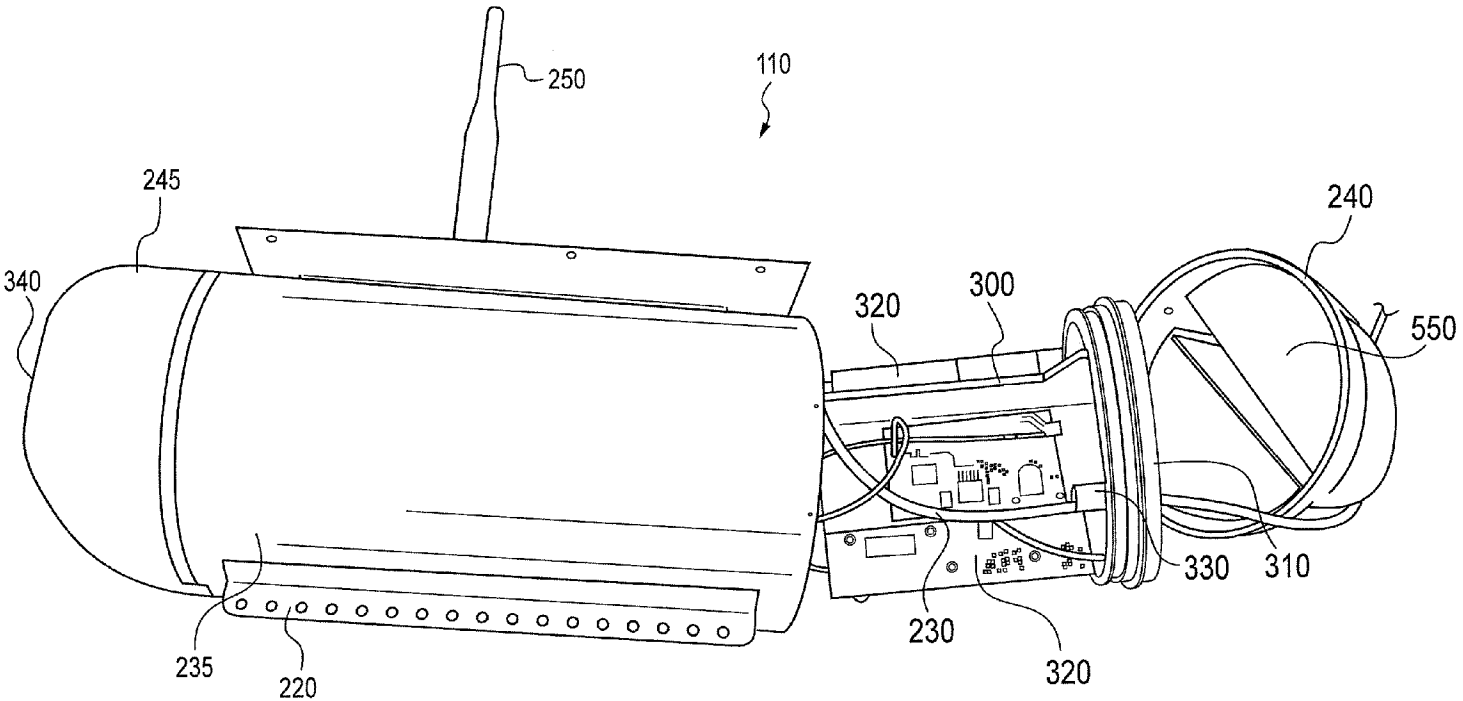
FIG. 3 is a partial internal view of a communications apparatus in accordance with an embodiment described herein.

FIG. 3 is a partial internal view of communications apparatus 110 in accordance with an embodiment described herein. Center hull body 235 is at least partially hollow. Aft bulkhead 310 separates aft section 240 from center hull body 235 and creates a watertight enclosure inside hull body 235 for storage of electronics assembly 320. If desired, tow body structure 210 can optionally include a fore bulkhead that separates fore section 245 from center hull body 235. Particular embodiments may optionally fill the inside of hollow hull body 235, aft section 240, and fore section 245 with foam 550 to achieve positive buoyancy. Fore section 245 has a convex surface with a V-shaped upper edge 540 for deflecting water as tow body 120 is towed on a water surface.

In accordance with an advantageous feature of the disclosed embodiment, the watertight chamber of center hull body 235 preferably encloses all electronics required for communications apparatus 110 except for antenna 250. Communications apparatus 110 may be rapidly integrated with many different types of UUV systems since UUV systems need only be able to send and receive data over standard Ethernet connection using standard internet protocol (IP) network protocols.

Heat sink plate 300 is preferably composed of aluminum and welded perpendicularly to aft bulkhead 310. Electronics assembly 320 is mounted on both sides of heat sink plate 300. Electronics assembly 320 is connected to 802.11 antenna 250 and a watertight connector 330 for tow cable 230. Alternatively, electronics assembly 320 may be potted inside hull body 235.

The present inventors have discovered that high signal attenuation, increased power consumption, and difficulty in detecting when an antenna has reached the surface result from locating only the 802.11 and GPS antennas on tow body 120 such that the two antennas are connected to radio receivers onboard UUV 170 via a RF coaxial cable. Therefore, UUV 170, preferably, incorporates a power over Ethernet module that co-locates radio electronics and antennas for both 802.11 and GPS frequency bands. Co-location of the radio electronics and antennas allows for a thin tow cable to be used for communications apparatus 110 and minimizes signal attenuation from the use of tow cable 230.

Tow cable 230 transfers both power and data between tow body electronics assembly 320 and UUV 170. The present inventors have found that using a coaxial cable to send RF signals to a surface antenna would significantly increase the overall weight of communications apparatus 110. At low operational speeds, tow body 120 would be unable to lift a heavy cable, thereby increasing the likelihood of entanglement and significantly reducing the operational range of UUV 170. Thus, tow cable 230 is preferably a fiber optic cable. Using a polypropylene jacket, fiber optic cable 230 can be made slightly buoyant, thereby, reducing the possibility of cable entanglement. If UUV 170 is stationary, a buoyant fiber optic cable 230 can reach the surface if the deployed cable scope is greater than the depth.

Figure 4B:
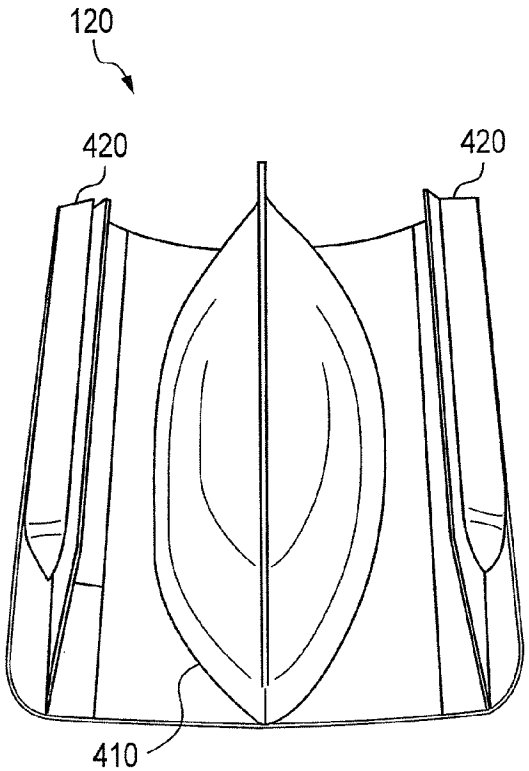
FIGS. 4A and 4B are respectively a front view diagram and a bottom view diagram of a tow body in accordance with an embodiment described herein.
Figure 4A:
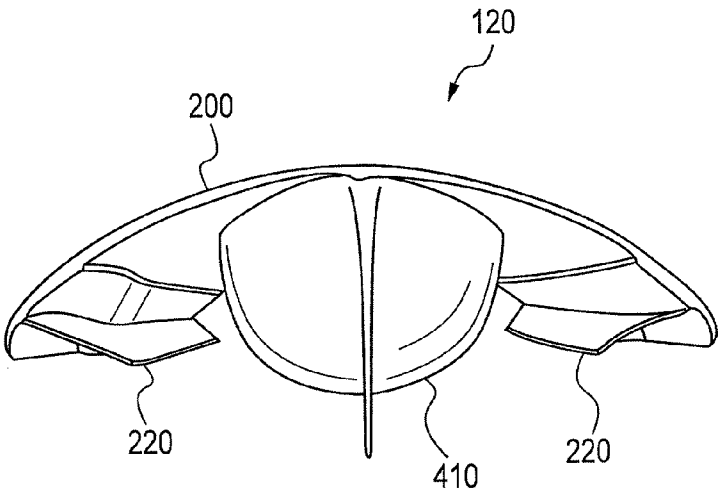

FIGS. 4A and 4B are respectively a front view diagram and a bottom view diagram of an alternative embodiment of tow body 120 having a hydrodynamic boat hull shaped body structure 410. An optional stabilizing side float 420 and at least one bridle attachment bar 220 each having at least one bridle attachment point are mounted onto a lifting wing 200 on either side of hull body 410. Lifting wing 200 is centered on and mounted on top of hull body 410. Those skilled in the art will appreciate that electronic assembly 320 can also be mounted inside boat hull shaped body structure 410.

Figure 5B:
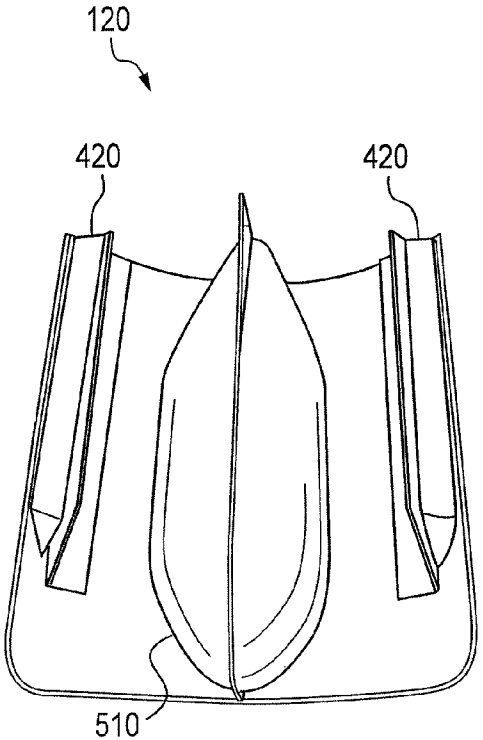
FIGS. 5A and 5B are respectively a front view diagram and a bottom view diagram of a tow body in accordance with another embodiment described herein.
Figure 5A:
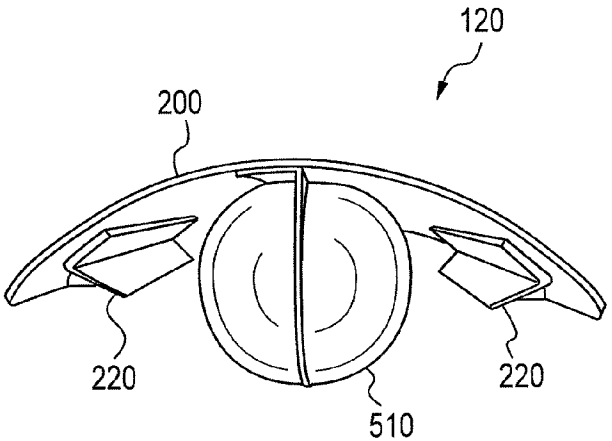

Another alternative embodiment of tow body 120 is illustrated in FIGS. 5A and 5B, which respectively depicts front and bottom views of tow body 120 having a hydrodynamic submarine shaped body structure 510. It will be appreciated by those skilled in the art that tow body 120 can have other alternative hydrodynamic and buoyant tow body structures.

While the embodiment of FIG. 3 is described with regard to multi-sectional tow body 120 of FIG. 2, it will be appreciated by those skilled in the art that the tow bodies disclosed in FIGS. 4A, 5A, and other hydrodynamic tow bodies may be appropriately modified to embody the principles of the invention described herein.

Figure 6:
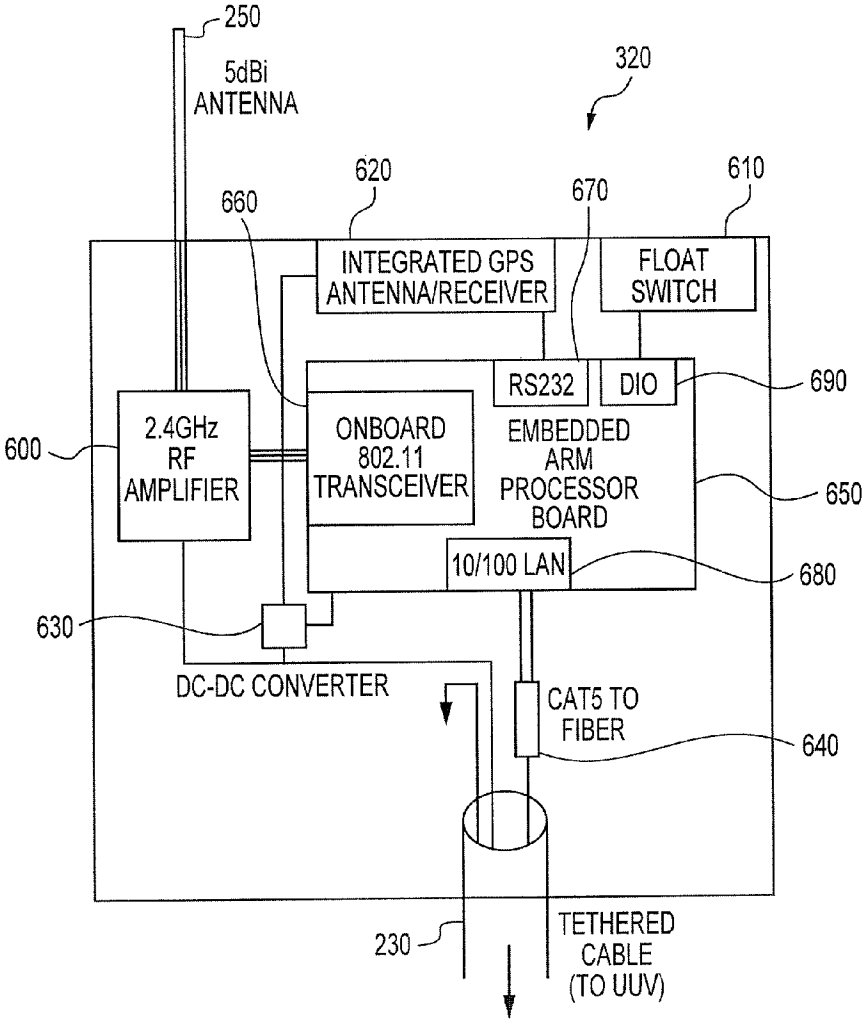
FIG. 6 is a schematic diagram of an electronics assembly of a communications apparatus in accordance with an embodiment described herein.

FIG. 6 is a schematic diagram of electronics assembly 320 in accordance with an embodiment described herein. Electronics assembly 320 contains an embedded processor 650 that relays data to and from UUV 170 via fiber optic cable 230. Embedded processor 650 contains an onboard 802.11 radio receiver chip 660, RS232-level serial interface 670 for GPS connectivity, 10/100 Ethernet LAN port 680 for tow cable 230, digital input/output 690, and sufficient CPU and memory for routing data at up to 54 Mbps between the Ethernet LAN port and the Wi-Fi interface of antenna 250. Antenna 250 is connected to 802.11 transceiver 660 onboard embedded processor 650. In addition to the 802.11 and GPS antennas, embedded processor 650 can be configured to capture other types of data, such as, for example, images with an onboard camera. Electronics assembly 320 also includes a float switch 610 connected to the digital input/output 690 of embedded processor 650, a DC power converter 630, and an Ethernet to fiber optic converter 640.

The example embodiment of FIG. 6 employs a Compulab CM-X270 computer-on-module board with a PXA270ARM processor to meet all of the above requirements, but other embedded processors that consume little power and space can be used. The Compulab CM-X270 board measures only 66×44×7 mm and consumes 2 W at maximum processor load.

An integrated GPS antenna and receiver module 620 is connected to a RS232-level serial interface 670. The integrated GPS antenna and receiver module 620 can be, for example, Mighty GPS's all-in-one BG-320RGT GPS module. The RS232-level serial interface 670 output is connected directly to the CM-X270 serial port of embedded processor 650. Tow body structure 210 is made of a non-metallic material and, thus, will not interfere with satellite reception.

Embedded processor 650 preferably supports the open source embedded Linux operating system, but any other operating system supported by embedded processor 650 may be used. The operating system on embedded processor 650 runs at least three software modules that together provide the required functionality for communications apparatus 110.

First, the disclosed embodiment includes network layer packet routing software to forward IP packets between UUV 170 and, for example, a remote surface receiver. The routing software should not buffer packets due to intermittent or slow wireless connections, for example, because buffering should be handled by a TCP control flow set up by UUV 170 or the remote surface receiver.

Second, embedded processor 650 includes a software module for supporting GPS navigation or other similar type platforms as known in the art. This software module receives, parses and decodes serial GPS NMEA 0813 messages from integrated GPS antenna and receiver module 620. The decoded GPS information would be collected and sent periodically to UUV 170 as, for example, a TCP, UDP, XML, or CORBA message through Ethernet LAN port 680.

Third, embedded processor 650 includes a software module for supporting communications between UUV 170 and communications apparatus 110. This software module sends status information to and receives command and control messages from UUV 170. Status information from embedded processor 650 includes, for example, wireless signal strength, available wireless networks, status of float switch 610 and GPS receiver 620, and other system information. Command messages from UUV 170 includes, for example, control over the transmit power, configured wireless network, encryption parameters, and other network and system configurations.

If desired, an optional bi-directional RF amplifier 600 can be added between antenna 250 and the onboard 802.11 radio receiver 620 to improve link reliability and boost transmit power. The disclosed embodiment uses a 2.4 GHz bi-directional RF amplifier, such as, for example, the 2400CAE 2.4 GHz bi-directional amplifier manufactured by RF Linx, which provides 1 W of transmit power and 20 dB of receive gain. Amplifier 600 is preferably mounted directly on heat sink plate 300 for improved heat dissipation.

In accordance with another illustrative feature of the disclosed embodiment, communications apparatus 110 has seawater cooling electronics capability. Referring to FIG. 2, vent holes 260 in aft cone 240 provide a constant supply of cooling water to heat sink plate 300. Electronics assembly 320 is ventilated with cooling water entering through the vent holes 260 located on aft section 240 and exiting through keel slot 265 on the underside of aft section 240. Alternatively, if electronics assembly 320 is potted inside hull body 235, amplifier 600 should be mounted at the lowest point of tow body structure 210 so that seawater can be used for heat dissipation.

Figure 7B:
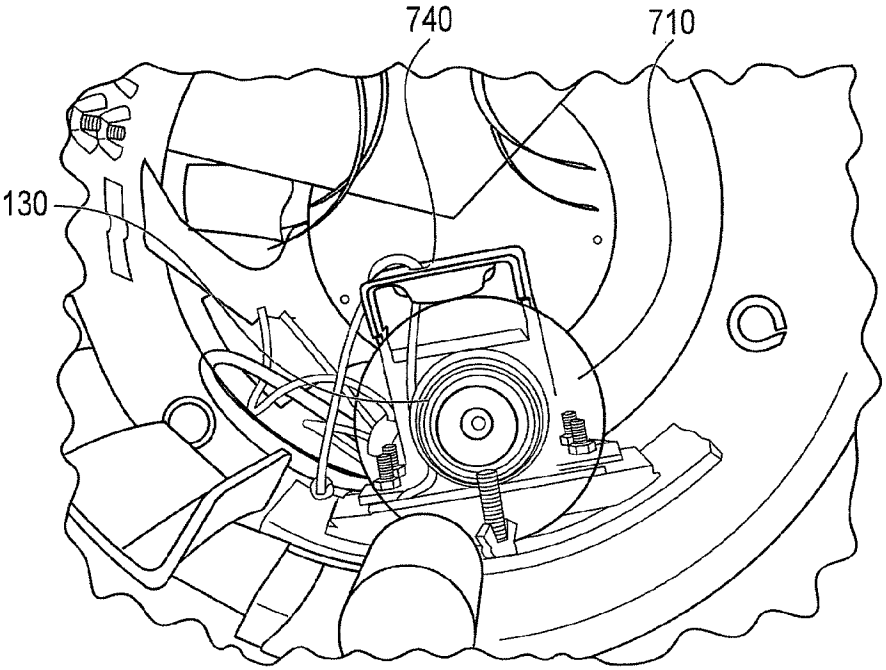
FIG. 7B is a diagram of a reeling assembly mounted inside a UUV system in accordance with an embodiment described herein.
Figure 7A:
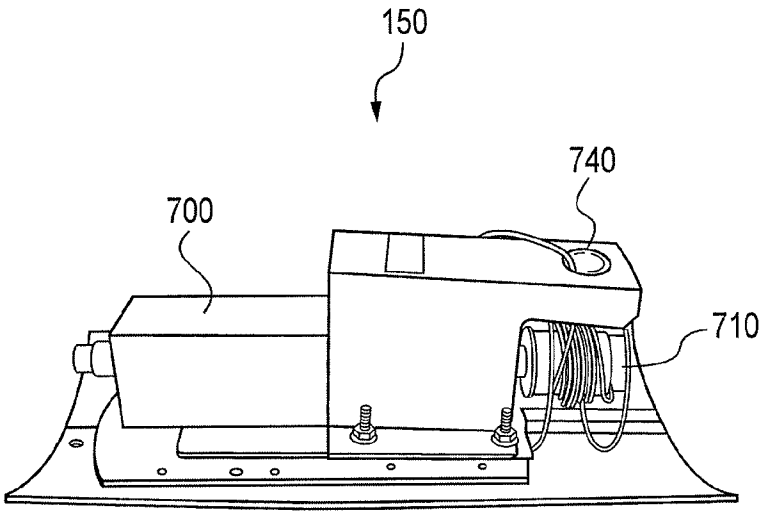
FIG. 7A is a diagram of a reeling assembly in accordance with an embodiment described herein.

FIG. 7A is a diagram of a reeling assembly 150 and FIG. 7B is a diagram of the reeling assembly 150 mounted inside UUV 170 in accordance with an embodiment described herein. Reeling assembly 150 includes a waterproof motor housing 700 enclosing a direct current (DC) motor with an attached spur gearbox (not shown), preferably having a 15:1 gear ratio, that is powered by a waterproof cable connected to a power supply and control switch in UUV 170. Control switch directs the power to the motor to control reeling tow body 120 in and out of tow body stowage area 160. Attached to the DC motor is a cable drum 710 large enough to accommodate the length of tether 130. Cable drum 710 sits inside a reel frame. If desired, a level wind can be mounted on cable drum 710 to prevent tether 130 from jamming during reeling of tow body 120.

Reeling assembly 150 provides tension for holding stowed tow body 120 inside UUV 170. If desired, an inner cover 740 which conforms to the bottom of tow body 120 can be mounted over reeling assembly 150 to streamline the tow body stowage area 160 and, thereby reduce drag. A hole in the cover 740 serves as a fairlead in directing tether 130 onto the drum 710. Once tow body 120 has reached the surface, float switch 610 of electronics assembly 320 is triggered to signal the DC motor to stop. High-speed communication to another vessel or shore platform and acquisition of GPS satellite data can then commence.

UUV 170 can provide all the power required to run electronics assembly 320 except for a small battery that runs a clock inside electronics assembly 320. Fiber optic cable 230 preferably contains two 24 American Wire Gauge (AWG) conductors for transporting power to tow body 120 from UUV 170 and a fiber for transporting data. A single 24 gauge wire provides almost 7 W of power at 12 V. The present inventors found that electronics assembly 320 would require approximately 2 W to 12 W depending on the RF amplifier used. If needed, additional power can be obtained by using a DC-DC converter 630 to step down the transmitted voltage at tow body 120.

Referring to FIG. 1, tow body 120 can be lifted to the surface within a UUV operational speed ranging from stationary to approximately 5 knots. After deploying to the water surface, tow body 120 should sit high on the water so that antenna 250 remains vertical and out of the water for better reception. Furthermore, tow body 120 must be stable at both planing and displacement speeds of up to approximately 5 knots for a prolonged period of time. The present inventors have discovered that the optimal attack angle $\alpha$ for tow body 120, measured relative to the water surface, is approximately 10 to 20 degrees. Tow body 120 can be towed smoothly on the surface within this range for attack angle $\alpha$.

Careful consideration must be given to selecting optimum location(s) to attach bridle(s) 270 to tow body 120 so that a sufficient lifting force is created to lift tow body 120 to the surface and the attack angle $\alpha$ is approximately 10 to 20 degrees when tow body 120 is pulled across the surface. The bridle attachment point(s) can be located on bridle attachment bars 220, vertical stabilizer 255, or at other locations including, for example, the tow body's 120 center of pressure and center of buoyancy. The present inventors have discovered that a two-point bridle attachment provided a stable configuration and low drag during underwater tow, surface tow, and transitions to and from the surface. The two bridle attachment points are located at the fore and aft ends of bridle attachment bar 220 extending from the bottom of tow body structure 210. Alternatively, the aft end attachment point can be located on vertical stabilizer 255 below the center of buoyancy, as shown in FIG. 2. By locating an attachment point on vertical stabilizer 255, bridle 270 can be used to extend vertical stabilizer 255 during deployment of tow body 120. It will be appreciated by those skilled in the art that other bridle attachment configurations may be employed, such as, for example, a single point attachment near the middle of bridle attachment bar 220 extending from the bottom of tow body structure 210, or a three point bridle attachment in which two attachment points are located on either fore corner of lifting wing 200 and a third attachment point is located on vertical stabilizer 255 below the center of buoyancy.

The foregoing merely illustrate the principles of the invention. Although the invention may be used to particular advantage in the context of submerged vehicles, those skilled in the art will be able to incorporate the invention into other non-vehicle systems, such as submerged platforms. It will thus be appreciated that those skilled in the art will be able to devise numerous alternative arrangements that, while not shown or described herein, embody the principles of the invention and thus are within its spirit and scope.

What is claimed as new and desired to be protected by Letters Patent of the United States is:

1. A tethered communications apparatus for providing a submerged vehicle with above-the-surface communications, the tethered communications apparatus comprising:

a tow body comprising:

a cylindrical and watertight hull body having an aft section partitioned by an aft bulkhead;

a heat sink plate extending from the aft bulkhead inside the cylindrical and watertight hull body;

an electronics assembly mounted to the heat sink plate; and a lift-generating wing attached to a top surface of the cylindrical and watertight hull body;

a cable attaching the tow body to the submerged vehicle; and an antenna connected to the tow body.

2. The tethered communications apparatus of claim 1, wherein the aft section is cone shaped.

3. The tethered communications apparatus of claim 1, wherein the cylindrical and watertight hull body has a cone shaped fore section, the cone shaped fore section having a V-shaped upper edge for deflecting water during surface tow.

4. The tethered communications apparatus of claim 1, wherein cooling water enters through a plurality of vent holes located about the aft section.

5. The tethered communications apparatus of claim 1, wherein the tow body is positively buoyant.

6. The tethered communications apparatus of claim 1, wherein the lift-generating wing provides hydrodynamic lift for lifting the tow body from under a water surface to at least partially above the water surface.

7. The tethered communications apparatus of claim 1, wherein the antenna provides the submerged vehicle with bi-directional radio frequency communications.

8. The tethered communications apparatus of claim 7, wherein a communications data rate of at least 1 Mbps is achieved at a distance of at least 1 km from the antenna.

9. The tethered communications apparatus of claim 1, wherein the antenna is mounted on top of the lift-generating wing.

10. The tethered communications apparatus of claim 9, wherein the antenna is spring-loaded for keeping the antenna substantially upright during surface tow and retracted during stowage.

11. The tethered communications apparatus of claim 9, wherein the antenna folds down during retrieval and stowage of the tethered communications apparatus.

12. The tethered communications apparatus of claim 1, wherein the cable is a fiber optic cable for transporting power and data between the tow body and the submerged vehicle.

13. The tethered communications apparatus of claim 12, wherein the electronics assembly comprises a processor with a wireless receiver, a DC power converter, an Ethernet to fiber optic converter, and a float switch.

14. The tethered communications apparatus of claim 13, wherein the electronics assembly further comprises a global positioning system antenna and receiver module connected to the processor.

15. The tethered communications apparatus of claim 13, wherein the electronics assembly further comprises a radio frequency amplifier connected to the antenna and the wireless receiver.

16. The tethered communications apparatus of claim 15, wherein the radio frequency amplifier is mounted directly to the heat sink plate.

17. The tethered communications apparatus of claim 6, wherein the tow body is towed at an angle between 10 to 20 degrees relative to the water surface.

18. The tethered communications apparatus of claim 1, wherein the cylindrical and watertight hull body is at least partially hollow.

19. The tethered communications apparatus of claim 6, wherein the lift-generating wing has a curved surface.

20. The tethered communications apparatus of claim 1, wherein the tow body further comprises a vertical stabilizer extending from a bottom of the cylindrical and watertight hull body.

21. An underwater vehicle capable of above-the-surface communications while stationary or traveling underwater, the underwater vehicle comprising:

an outer hull having a tow body stowage area;

a communications apparatus stored in the tow body stowage area, the communications apparatus comprising:

a tow body comprising:

a hull body;

an electronics assembly mounted inside the hull body;

a vertical stabilizer projecting from a keel slot located on the hull body; and a lifting wing attached to a top surface of the hull body, wherein the lifting wing forms part of the outer hull when the communications apparatus is stored in the tow body stowage area; and an antenna mounted to an upper surface of the lifting wing;

at least one bridle attachment point on the tow body; and a cable tethering the tow body from the at least one bridle attachment point to a reeling assembly inside the underwater vehicle.

22. The underwater vehicle of claim 21, wherein a bridle attachment is used to tether the tow body to the underwater vehicle.

23. The underwater vehicle of claim 21, wherein the electronics assembly comprises a processor with a wireless receiver, a DC power converter, an Ethernet to fiber optic converter, and a float switch.

24. The underwater vehicle of claim 21, wherein the hull body is multi-sectional having a fore section, a center section, and an aft section, the fore and aft sections separated from the center section by fore and aft bulkheads, respectively.

25. The underwater vehicle of claim 24, wherein a heat sink plate extends from the aft bulkhead inside the center section.

26. The underwater vehicle of claim 25, wherein the electronics assembly is mounted to the heat sink plate.

27. The underwater vehicle of claim 26, wherein cooling water enters through a plurality of vent holes located about the aft section and exiting through the keel slot.

28. The underwater vehicle of claim 21, wherein the hull body comprises an aft section and a center section, and the electronics assembly is mounted inside the aft section of the hull body.

29. The underwater vehicle of claim 23, wherein the electronics assembly further comprises a power over Ethernet module for receiving multiplexed data and power and supplying power and data to the processor.

30. The underwater vehicle of claim 29, wherein the cable transports data and power between the underwater vehicle and the communications apparatus.

31. The underwater vehicle of claim 29, wherein power is supplied from the underwater vehicle to the communications apparatus.

32. The underwater vehicle of claim 21, wherein the communications apparatus is positively buoyant enabling the communications apparatus to float to the surface using hydrostatic force when the underwater vehicle is stationary.

33. The underwater vehicle of claim 21, wherein the communications apparatus can be lifted to the surface using hydrodynamic force when the underwater vehicle is traveling underwater at a speed of up to approximately five knots.

34. The underwater vehicle of claim 21, wherein the tow body is towed at an angle between 10 to 20 degrees relative to the surface.

35. The underwater vehicle of claim 21, wherein the antenna is spring-loaded for keeping the antenna substantially upright during surface tow and retracted when the tow body is stowed.

36. The underwater vehicle of claim 21, wherein the communications apparatus can be retrieved and stowed in the tow body stowage area after the above-the-surface communications.

37. The underwater vehicle of claim 21, wherein the vertical stabilizer prevents the tow body from yawing during surface tow.

38. The underwater vehicle of claim 25, wherein the heat sink plate is composed of aluminum.

39. The underwater vehicle of claim 21, wherein the electronics assembly further comprises a global positioning system antenna and receiver.

* * * * *